US009309642B2

(12) United States Patent
Patriciu

(10) Patent No.: US 9,309,642 B2
(45) Date of Patent: Apr. 12, 2016

(54) SUBSEA MINING TOOL INCLUDING A SUCTION MOUTH

(71) Applicant: MARINE RESOURCES EXPLORATION INTERNATIONAL B.V., Laren (NL)

(72) Inventor: Dan Costache Patriciu, Bucharest (RO)

(73) Assignee: Marine Resources Exploration International BV (NL)

( * ) Notice: Subject to any disclaimer, the term of this patent is extended or adjusted under 35 U.S.C. 154(b) by 85 days.

(21) Appl. No.: 14/348,818

(22) PCT Filed: Oct. 2, 2012

(86) PCT No.: PCT/EP2012/004126
§ 371 (c)(1),
(2) Date: Mar. 31, 2014

(87) PCT Pub. No.: WO2013/050136
PCT Pub. Date: Apr. 11, 2013

(65) Prior Publication Data

US 2014/0283420 A1 Sep. 25, 2014

(30) Foreign Application Priority Data

Oct. 3, 2011 (GB) ..... 1116981.0

(51) Int. Cl.
*E02F 3/88* (2006.01)
*E02F 3/92* (2006.01)
*E02F 3/90* (2006.01)

(52) U.S. Cl.
CPC ..... *E02F 3/92* (2013.01); *E02F 3/8866* (2013.01); *E02F 3/902* (2013.01); *E02F 3/907* (2013.01); *E02F 3/925* (2013.01); *E02F 3/9262* (2013.01); *E02F 3/9293* (2013.01)

(58) Field of Classification Search
USPC ..... 37/309, 311, 313, 321, 323, 335
IPC ..... E02F 3/92,3/8866, 3/907, 3/9262
See application file for complete search history.

(56) References Cited

U.S. PATENT DOCUMENTS 528,022 A * 10/1894 Patterson ..... 37/333
611,614 A * 10/1898 Edwards ..... 37/333

(Continued)

FOREIGN PATENT DOCUMENTS

DE 3923113 A1 1/1991
GB 1 488 508 10/1977

(Continued)

OTHER PUBLICATIONS

United Kingdom Examination Report Corresponding to Application No. GB1116981.0; Date of Report: Nov. 24, 2014; 3 Pages.

(Continued)

*Primary Examiner* — Gary Hartmann
(74) *Attorney, Agent, or Firm* — Myers Bigel & Sibley, P.A.

(57) ABSTRACT

A suction mouth (10) for mounting on the front of a subsea mining tool and to be pushed into sediment. The suction mouth comprises a hollow body (12) having an entrance opening (14) and an exit opening (16), wherein the body converges from the entrance opening towards the exit opening. The entrance opening has a lower lip (20) and an upper lip (22), and the upper lip comprises an extension (22*a*) projecting forwardly and upwardly relative to the lower lip to form a canopy over the entrance opening. The suction mouth (10) may include a valve (30) on the body downstream of the entrance opening which is operable to selectively provide a further entrance opening into the body. Where such a valve is present, the consistency of the material sucked in can be regulated.

15 Claims, 6 Drawing Sheets

(56) References Cited

U.S. PATENT DOCUMENTS

| | | | | | |
|---|---|---|---|---|---|
| 692,815 | A | * | 2/1902 | Bates | 37/323 |
| 909,543 | A | * | 1/1909 | Carlesimo | 37/321 |
| 3,774,323 | A | * | 11/1973 | Vaughn | 37/317 |
| 3,783,535 | A | | 1/1974 | Hanks | |
| 4,232,903 | A | | 11/1980 | Welling et al. | |
| 4,259,795 | A | | 4/1981 | Verboom | |
| 4,437,244 | A | * | 3/1984 | Verboom | 37/323 |
| 4,681,372 | A | | 7/1987 | McClure | |
| 5,546,682 | A | * | 8/1996 | Skerry | 37/322 |
| 6,017,400 | A | * | 1/2000 | Clark et al. | 134/21 |
| 7,395,618 | B2 | * | 7/2008 | Jacobsen et al. | 37/313 |
| 7,552,551 | B2 | * | 6/2009 | Kohutko | 37/341 |
| 2007/0130807 | A1 | | 6/2007 | Kohutko | |
| 2011/0296720 | A1 | * | 12/2011 | Tack | 37/323 |
| 2014/0190044 | A1 | * | 7/2014 | Wezemer | 37/333 |

FOREIGN PATENT DOCUMENTS

| | | | |
|---|---|---|---|
| GB | 2383257 | A | 6/2003 |
| GB | 2 491 570 | | 12/2012 |
| WO | WO 98/51395 | A1 | 11/1998 |
| WO | WO 2005/021878 | A1 | 3/2005 |
| WO | WO 2010/000289 | A1 | 1/2010 |

OTHER PUBLICATIONS

PCT International Search Report and Written Opinion corresponding to International Application No. PCT/EP2012/004126; Date of mailing of the International Search Report and Written Opinion, Jan. 30, 2013; 12 pages.

* cited by examiner

Section A-A

Section B-B

Section C-C

Section D-D

SUBSEA MINING TOOL INCLUDING A SUCTION MOUTH

RELATED APPLICATIONS

This application is a 35 U.S.C. §371 national stage application of PCT Application No. PCT/EP2012/004126, filed on Oct. 2, 2012, which claims priority from Great Britain Patent Application No. 1116981.0, filed Oct. 3, 2011, the contents of which are incorporated herein by reference in their entireties. The above-referenced PCT International Application was published in the English language as International Publication No. WO 2013/050136 A1 on Apr. 11, 2013.

TECHNICAL FIELD

The present invention relates to a suction mouth for a subsea mining tool designed to mine layers of sediment on the sea bed.

BACKGROUND

In WO 2010/000289 a method and apparatus for mining and processing sea bed sediment is provided. The apparatus consists of a crawler vehicle for travelling across the sea bed, which disturbs sediment. The vehicle includes a suction system to recover the disturbed sediment. The present invention describes a suction mouth for the suction system of such a mining tool.

U.S. Pat. No. 4,232,903 describes an ocean mining system for mining manganese nodules. A subsea mining vehicle is propelled by Archimedes screws. The vehicle uses a rake and conveyor system to pick up nodules, which are then washed, crushed and passed through a riser to a surface vessel.

Various excavation tools from dredging operations are known for mining materials such as sand, silt or gravel. Typically such materials are recovered using a drag head mounted on a trailing suction hopper dredger. The drag head is pulled along and sucks up material from behind the dredger. This is suitable for use in relatively shallow water depths and where the sediment layer is able to support the weight of the dredger. For softer sediment layers a suction mouth mounted on the front of a vehicle is required so that the suction mouth can be pushed forward into the sediment layer. This limits disturbance of the sediment by the propulsion system used.

SUMMARY

The present invention is directed to providing a new suction mouth to assist with recovering softer materials, such as sapropel and cocolith, for which use of a drag head is inappropriate. The suction mouth has been designed to provide efficient extraction of multi-layer sediments from the sea floor which extend relatively thinly but over a wide area. In some areas various sediments exist which differ from one another by water content, fluidity, density, and ability to maintain a certain shape after disturbance and suction in an adjacent area. For example, there may be a very fluid cocolith layer, plus layers of sapropel and mineral mud. To recover these layers it is necessary to provide for disturbance of the sediments, mixing of the sediments with seawater to provide a slurry and suction of the slurry which consists of the sapropel, cocolith and approximately 10% mineral mud.

The present invention provides a suction mouth for mounting on the front of a subsea mining tool and to be pushed into sediment, comprising a hollow body having an entrance opening and an exit opening, wherein the body converges from the entrance opening towards the exit opening, the entrance opening has a lower lip and an upper lip, and wherein the upper lip comprises an extension projecting forwardly and upwardly relative to the lower lip to form a canopy over the entrance opening.

This configuration of suction mouth is well suited to recovering softer material, when the suction mouth is pushed ahead of the vehicle. The protrusion of the upper lip beyond the lower lip reduces the tendency of the mouth to burrow into the seabed, while the projecting upper lip provides for ready access of free water to assist in the formation of slurry.

The suction mouth preferably further comprises a plurality of guide plates spaced across the width of the entrance opening and projecting downwardly from the upper lip extension to the lower lip. In use, these guide plates help the suction mouth to move across the seabed and to ride over obstacles and act as a coarse filter to prevent large objects from entering the mouth. The guide plates may have a very small dimension in the direction towards the exit such that they are little more than bars. However, preferably, the guide plates extend towards the exit opening at least beyond the lower lip.

A glide shoe may be formed on the underside of the lower lip. This spreads the weight of the suction mouth and helps to reduce the tendency for the lower lip to dig into the surface.

In one example the entrance opening is rectangular. Alternatively, the entrance opening may be trapezoidal, narrowing from the lower lip towards the upper lip. This improves the efficiency of recovery of sediment.

Preferably the suction mouth further comprises a valve on the body downstream of the entrance opening which is operable to selectively provide a further entrance opening into the body. In this way the consistency of the material sucked in can be regulated.

The suction mouth may also comprise one or more nozzles for providing jets of fluid, which help to break up and slurrify the sediment. One or more nozzles may be located on the upper lip extension and/or on the lower lip.

In one example the entrance opening has a maximum width of 10 m and a maximum height of 0.35 m. Such dimensions are particularly suitable when the suction mouth is intended for use in locations with a sediment layer about 1.5 m thick.

The present invention also provides a subsea mining tool comprising a subsea vehicle including a suction mouth as set out above mounted on the front of the vehicle.

Preferably the suction mouth is pivotably connected to the vehicle and the mining tool may further comprise means to adjust the position of the suction mouth relative to the vehicle. This adjusting means may be one or more hydraulic cylinders.

The exit opening of the suction mouth may be connected to a suction system on the vehicle by a flexible pipe.

Advantageously, the subsea mining tool may further comprise a detection system for detection of different layers of sediment to be mined, detection of obstacles and monitoring the path of the tool.

The detection system may comprise at least one sensor mounted on a frame extending above and in front of the suction mouth, with the or each sensor arranged to face downwardly towards the sediment.

The detection system preferably further comprises at least one sensor arranged to face forwards in the direction of travel of the tool for path and obstacle detection.

BRIEF DESCRIPTION OF THE DRAWINGS

The invention will now be described in detail, by way of example only with reference to the accompanying drawings in which.

DETAILED DESCRIPTION

A suction mouth 10 for use with a subsea mining tool in accordance with one embodiment of the present invention is shown in FIGS. 1-6. The suction mouth 10 is intended to be mounted on the front of a subsea vehicle so that in use it is pushed forward into a layer of sediment and sucks the sediment in with horizontal suction. This is considered more effective than sucking up material vertically.

Figure 3A:
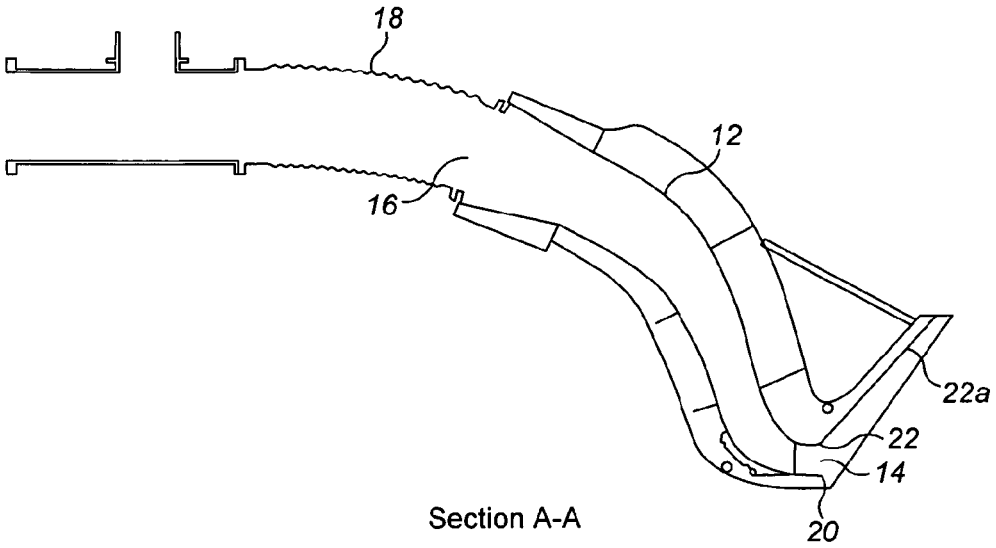
FIGS. 3*a*-3*d* are sectional views of FIGS. 1 and 2 along the lines A-A, B-B, C-C and D-D respectively.
Figure 3B:
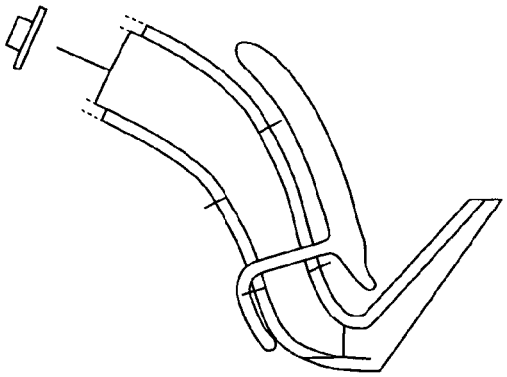
Figure 3C:
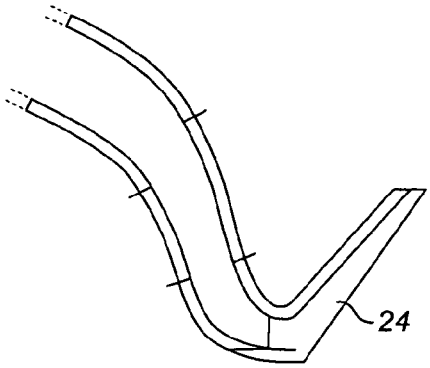
Figure 3D:
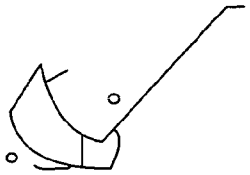
Figure 4:
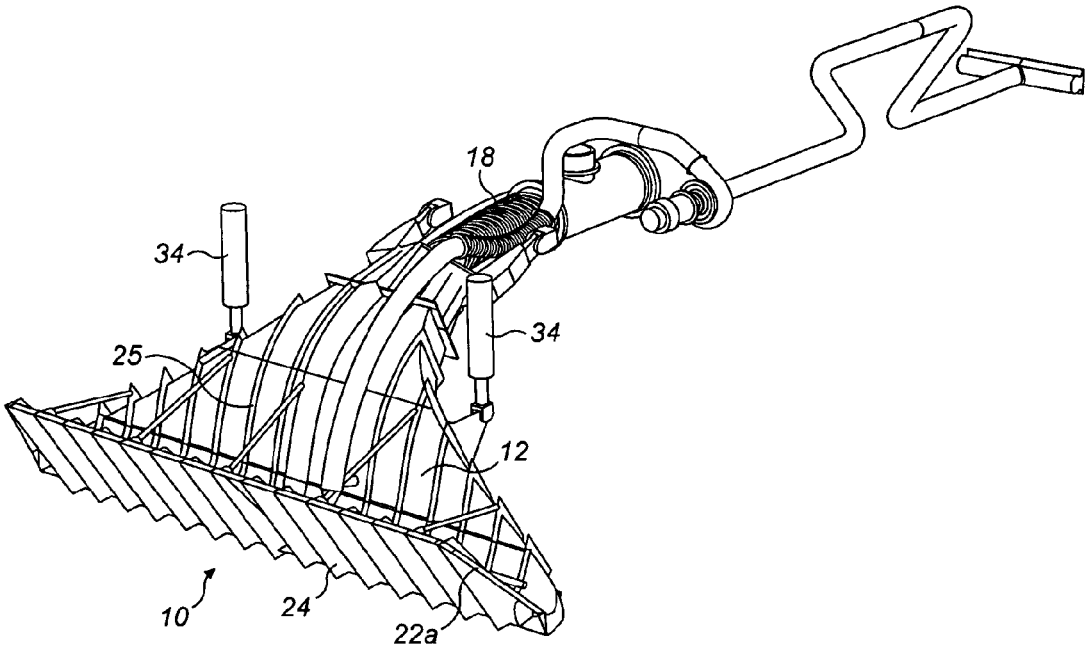
FIG. 4 is a perspective view from the front of the suction mouth of FIG. 1.

The suction mouth 10 consists of a hollow body 12 generally in the form of a flattened cone. Thus, it is generally triangular in plan view to provide a wide entrance opening 14 at the front converging to a narrow exit opening 16 at the rear. As best seen in FIG. 3*a*, the body 12 is curved so that entrance opening 14 and exit opening 16 are not level with each other. In use the entrance opening 14 is lowermost and the exit opening uppermost.

The exit opening 16 is connected to a suction conduit 18. In use, sediment is drawn into the entrance opening 14, passes up through the hollow body 12 and out through the exit opening 16 into the suction conduit 18. The exit opening 16 is preferably circular for ease of connection to piping forming the suction conduit 18.

Figure 2:
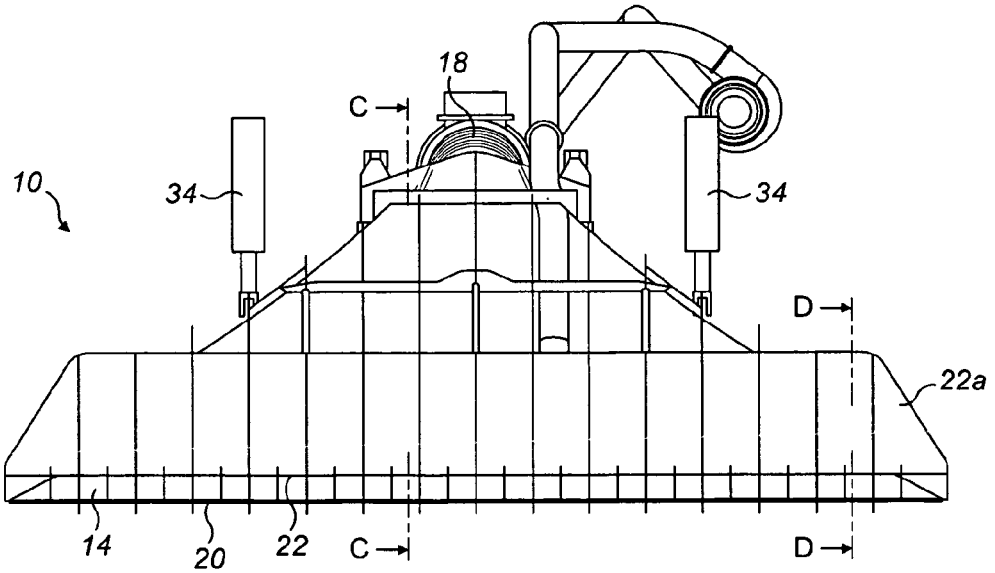
FIG. 2 is a front view of the suction mouth of FIG. 1.

The entrance opening 14 viewed from the front as in FIG. 2 may be the shape of a wide, shallow rectangle. However, more preferably, the entrance opening 14 is a wide, shallow trapezium shape, being widest along its lower lip 20 and narrowing slightly towards the upper lip 22.

The upper lip 22 has an extension 22*a* which projects forwardly and upwardly from the entrance opening 14 to form a flared canopy above and forward of the entrance opening 14. This directs sediment towards the entrance opening 14 as well as sucking in water from above the sediment to assist in the slurry formation. A series of plates or ribs 24 project from the downward facing surface of the upper lip extension 22*a*. These strengthen the upper lip extension 22*a* and serve as guide plates as the suction mouth 10 is moved across the sea bed, as discussed further below.

The guide plates 24 extend downwardly to extend across the entrance opening 14, thus forming obstructions across the opening to prevent larger objects from entering the suction mouth 10.

Figure 1:
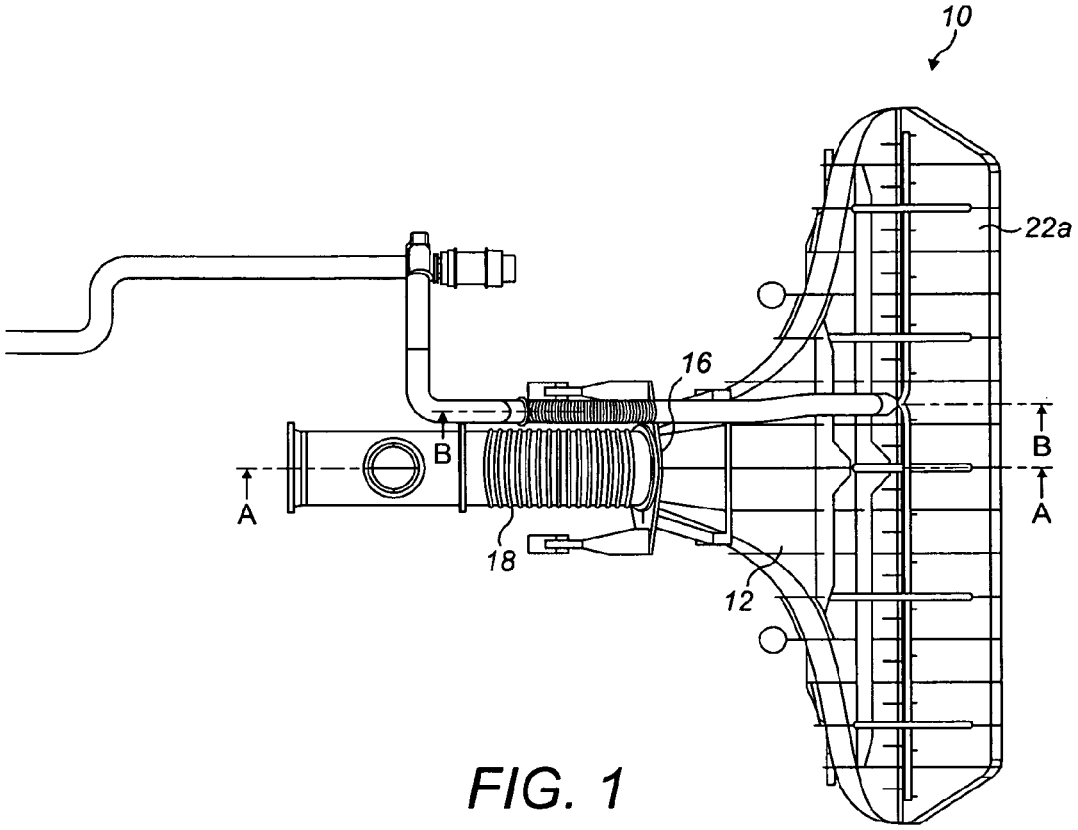
FIG. 1 is a plan view of a suction mouth in accordance with one embodiment of the present invention.
Figure 5:
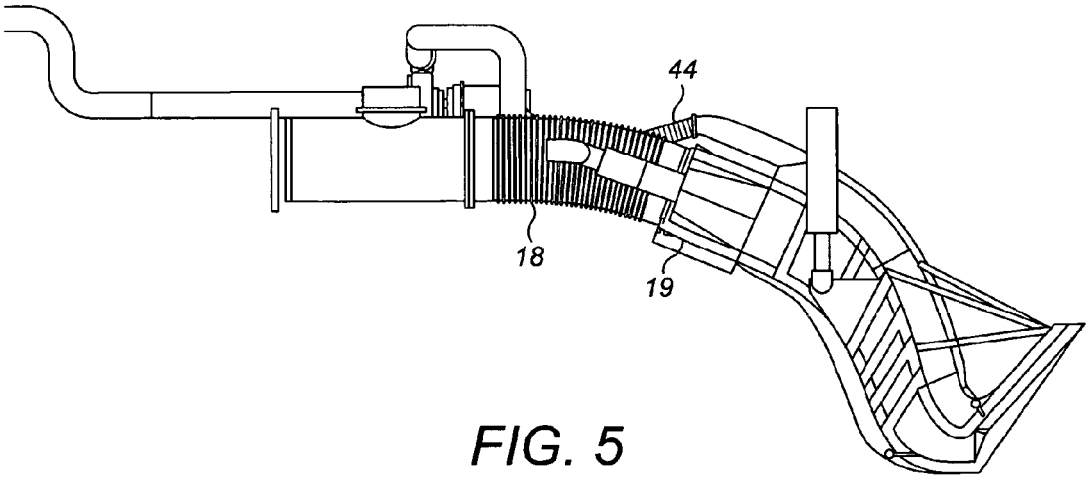
FIG. 5 is a longitudinal sectional view of the suction mouth of FIG. 4.

The dimensions of the suction mouth 10 will depend on the nature of the sediment to be recovered. In a typical example, for a sediment layer with a depth of between about 0.4 m and 1.5, possible dimensions for the suction mouth 10 are as follows and as indicated in FIGS. 1 and 5:

Suction mouth width: 10 m

Suction mouth height: 1.7 m (to the free edge of upper lip extension 22*a*)

Entrance opening height: 0.3 m (dimension from lower lip vertically up to upper face of mouth)

Exit opening diameter: 0.95 m

Angle of upper lip extension to horizontal: 50°

Length of suction mouth front to back: 5 m

Spacing of guide plates: 0.3 m

It will be appreciated that these are not limiting and merely show one possible example.

The suction mouth 10 may be formed of welded mild steel. External stiffening ribs 25 may be welded to the suction mouth 10 to strengthen it and avoid implosion due to under-pressure.

Figure 6:
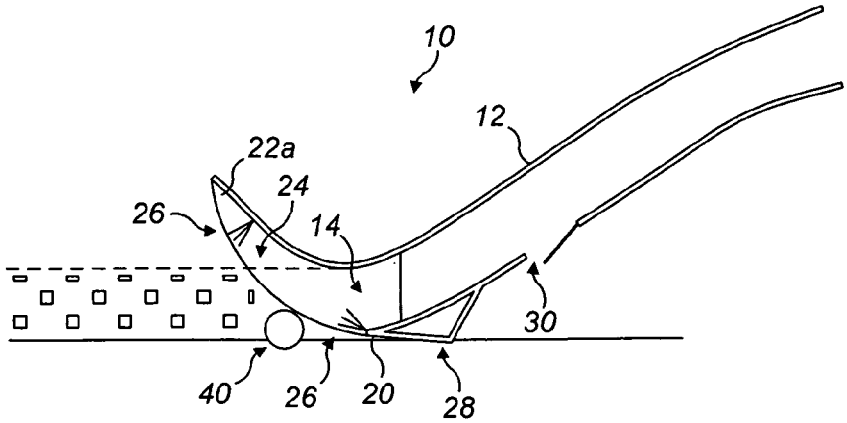
FIG. 6 is a schematic cross-sectional side view of the suction mouth.

As best seen in FIG. 6, nozzles 26 for providing jets of water may be provided on the upper lip extension 22*a* and/or the lower lip 20 of the suction mouth 10. The nozzles 26 direct jets of water towards the sediment to help break it up and mix it into a slurry.

A glide shoe 28 may be provided on the underside of the lower lip 20. This provides a smooth surface to pass over the sea bed as the vehicle carrying the suction mouth 10 travels. The glide shoe 28 spreads the weight of the suction mouth 10 to avoid the lower lip 20 from digging into the surface. The angle of the glide shoe 28 may be adjustable, for example by a hydraulic cylinder.

Rearward of the glide shoe 28, one or more valves 30 may be provided to allow free water to enter the suction mouth 10. In this way, the consistency of the slurry can be regulated and optimised for efficient working of the suction system. A vacuum relief valve may also be provided in case the suction mouth 10 becomes clogged and a vacuum is formed downstream.

Figure 9:
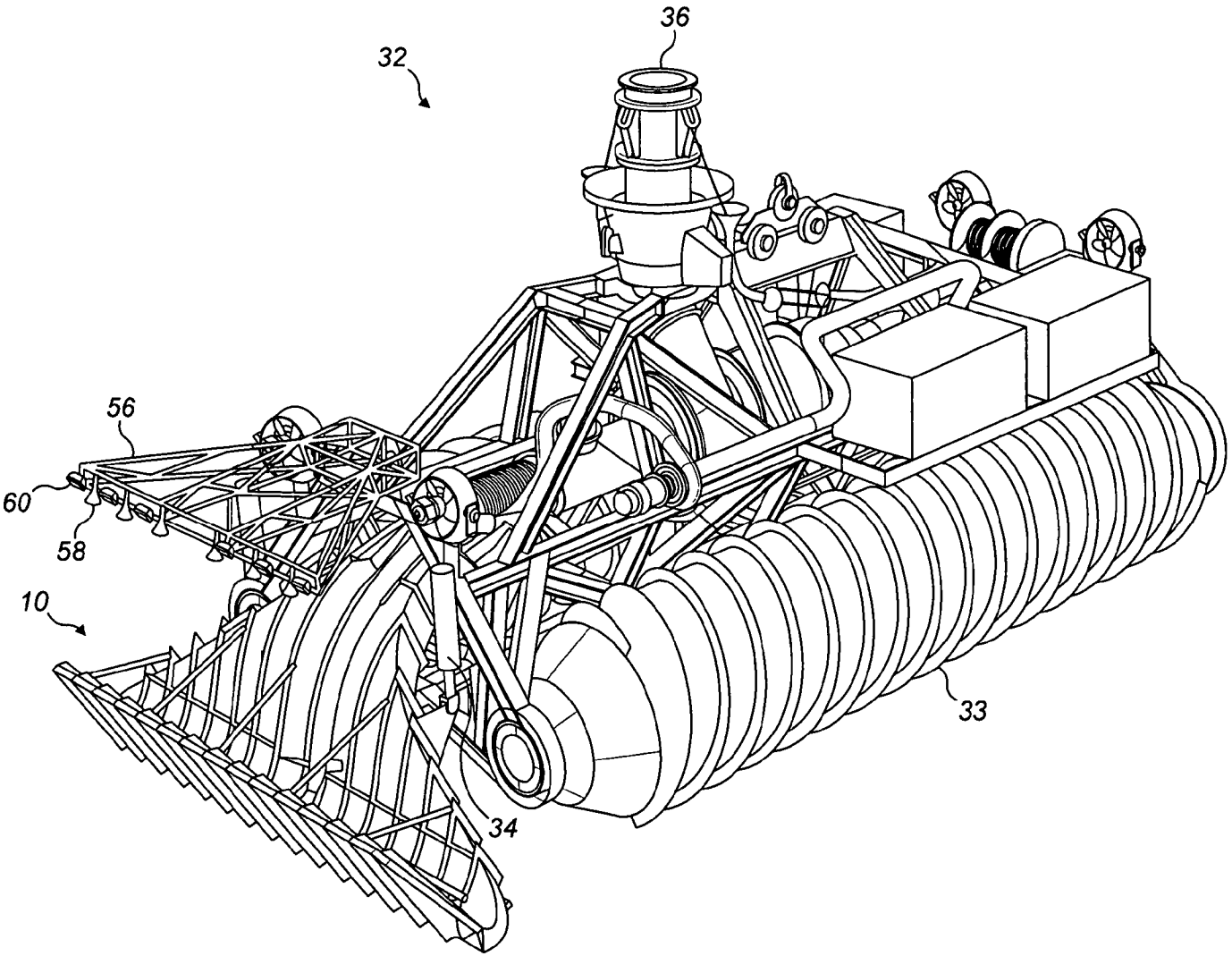
FIG. 9 is a perspective view of a subsea mining tool with a suction mouth mounted thereon.

As illustrated in FIG. 9, in use, the suction mouth 10 may be mounted on the front of a subsea mining tool in the form of a vehicle 32 (illustrated schematically) with motive means such as crawlers or Archimedes screws 33, which allow the vehicle 32 to travel across the sea bed. The suction mouth 10 is suspended from the vehicle 32, preferably by two pivot arms hingedly connected to the vehicle, to allow for relative movement. The exit opening 16 of the suction mouth 10 is connected to a suction conduit 18 on the vehicle 32. Preferably the suction conduit 18 is a flexible hose to allow for some freedom of movement of the suction mouth 10 relative to the vehicle 32. The flexible hose may be provided with steel support rings and a turning gland 19 may be provided to allow the suction mouth 10 to turn axially to follow the sediment during operation.

Active height adjustment for the suction mouth 10 can be provided, for example by hydraulic cylinders 34. Once the suction mouth 10 rests on the seabed the hydraulic cylinders 34 may be set hydraulically free and the suction mouth 10 will set its height passively, carrying its weight on the glide shoe 28.

In order to control the vehicle 32 and determine the optimal height for the active height adjustment, the vehicle 32 is provided with a real time detection system. This takes the form of a number of sensors mounted on a retractable frame in front of the vehicle. The sensors scan the soil in front of the vehicle for several objectives, namely the detection of objects to be avoided, both below the surface and in the direct surroundings of the vehicle, to ensure that the correct path is being followed, and to determine the depth of deposit to feed back to the height adjustment for the suction mouth.

Figure 10:
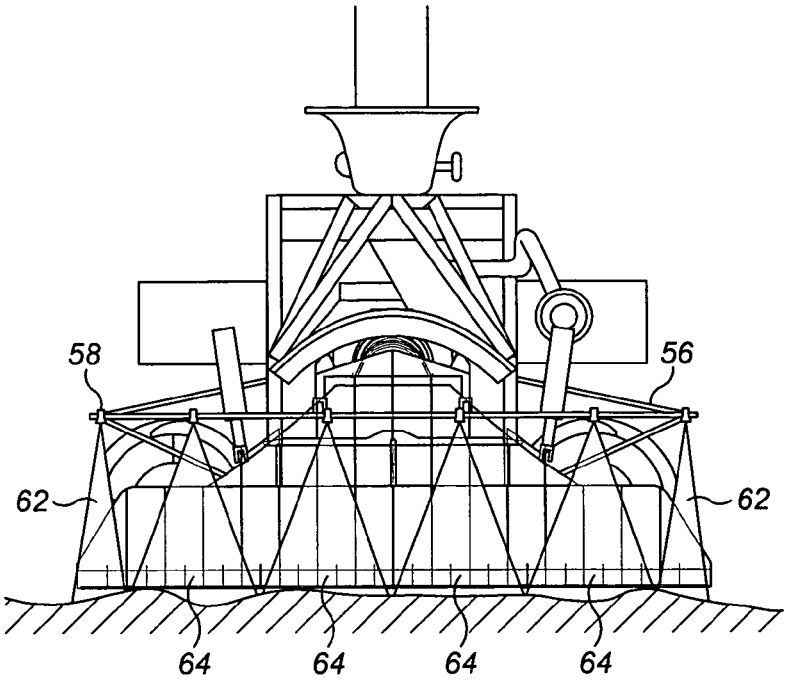
FIG. 10 is a schematic front view of part of a subsea mining vehicle with parts of the detection system mounted thereon.
Figure 11:
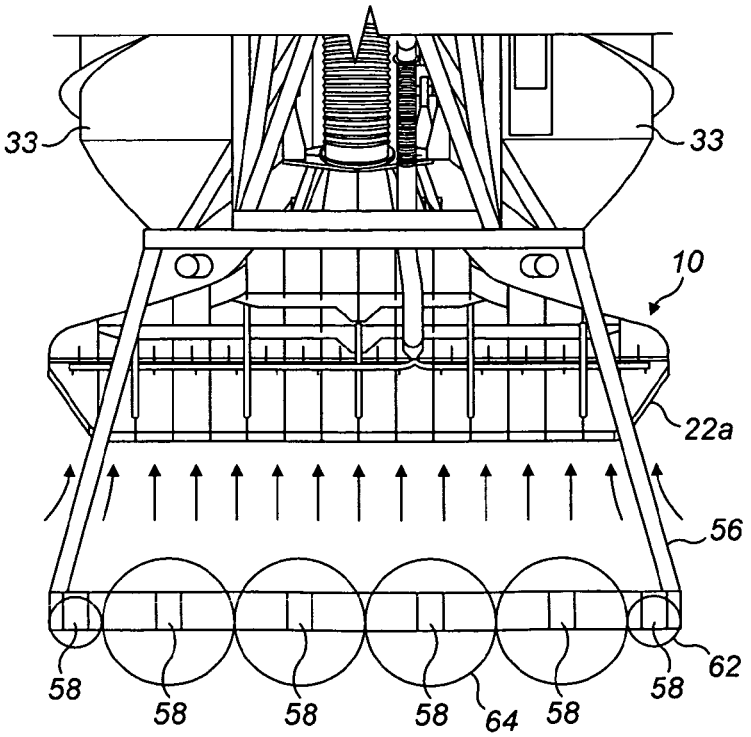
FIG. 11 is a schematic plan view of FIG. 9.

FIGS. 9-11 show an example of the detection system 54, FIGS. 10 and 11 being in schematic form only. A retractable frame 56 extends forwardly and above the suction mouth 10. In this example, six downward-looking sensors 58 and six forward-looking sensors 60 are mounted on the frame 56. The downward-looking sensors 58 at either end have a narrower beam angle 62, for example approximately 15°, while the four sensors 58 therebetween have a wider beam angle 64, for example approximately 39°. The sensors 58 are mounted approximately 3 meters above the sea floor to ensure that they obtain full coverage across the entire width of the suction mouth 10. The sensors 58 are also approximately 3.2 meters in front of the upper lip extension 22*a* of the suction mouth 10 to provide a gap of approximately 2 meters between the metal of the suction mouth 10 and the beam footprints of the wide inner beams 64, to ensure that no signal is picked up from the suction mouth 10 of the vehicle itself. These dimensions are merely exemplary and not limiting.

The downward-looking sensors 58 can produce a profile of the bottom of the slurry layer using a low frequency scan. This produces a map of the soil in situ density variations with depth in front of the vehicle 32. These density variations with depth determine the transition between the layers (for example between a layer of sapropel to be extracted and a layer of mineral mud which is not extracted). The plot generated by the sensors 58 shows the soil height that can be excavated and this determines the suction mouth position and vehicle speed. For example, at a thin area of material to be extracted, the mouth is raised so as to extract only the layer of interest and its speed is increased as it will take less time to harvest this thinner layer.

The six forward-looking sensors 60 monitor the path of the vehicle 32, to ensure that it is parallel and close to the previous lane, and to detect large obstacles on the seabed.

The downwardly looking sensors 58 for density detection may be one of the following types:

(i) gamma transmission type sensors, which are generally based on absorption of gamma radiation by the medium between the source and the detector;

(ii) ultra-sonic acoustic reflection sensors, which record the signal reflection caused by the difference in acoustic impedance between the medium and the sensor;

(iii) sub-bottom profilers, which are placed at a certain distance from the seabed, typically a few meters, and record signal reflections caused by density differences in the seabed; and (iv) optical backscattering sensors, which generally work in the very low density range, in the order of ($g/m^3$) such as turbidity sensors.

The forward-looking sensors 60 for imaging of the vehicle path and obstacles may be one of the following types:

(i) video imaging sensors, using a light source with a spectrum that matches the sensitive spectrum of the detector (e.g. a CCD); and (ii) fluorescence type sensors, which use a light source with a wavelength outside the sensitive window of the detector and can have a much higher signal to noise ratio than standard illumination, although working only for fluorescent materials.

The suction conduit 18 is itself connected to further piping mounted on the vehicle 32 leading to a riser system 36 for passing the slurry to the surface as disclosed in WO 2010/000289. Suction is provided, for example by a centrifugal dredge pump with an electric drive motor. Further details of the vertical transport system used for transferring the slurry to the surface can be found in the applicant's co-pending application Ser. No. 14/349,015, published as U.S. Publication No. 2014/0318803. In addition, the applicant's co-pending application Ser. No. 14/347,158, Published as U.S. Publication No. 2014/0230287 describes a mining pattern which may be adopted by the vehicle 32.

As the vehicle 32 travels forwards, the suction mouth 10 is pushed forward, with the glide shoe 28 allowing the suction mouth 10 to glide smoothly along the seabed. As the vehicle 32 moves, the sediment layer is effectively bulldozed into the suction mouth 10. The upper lip extension 22*a* tends to divert and guide sediment and free water towards the entrance opening 14. The guide plates 24 help to break up the sediment and tend to push the suction mouth 10 upwards so that it will ride over any large obstacles 40 such as lumps of heavier mud or rocks which cannot be broken up and which could not or should not enter the suction system. Smaller heavy objects may simply be pushed into the soft mud beneath the vehicle 32 by the glide shoe 28, under the weight of the suction mouth 10.

A pump and appropriate piping 42 provides water to the nozzles 26 to form water jets. This piping also includes a flexible connection 44 to allow for relative movement between the parts mounted on the suction mouth 10 and the parts mounted on the vehicle 32. The water jets provided by the nozzles 26 add erosive force to loosen and mix the sediment with free water in order to slurrify it and allow it to be sucked up by the suction mouth 10.

Figure 7:
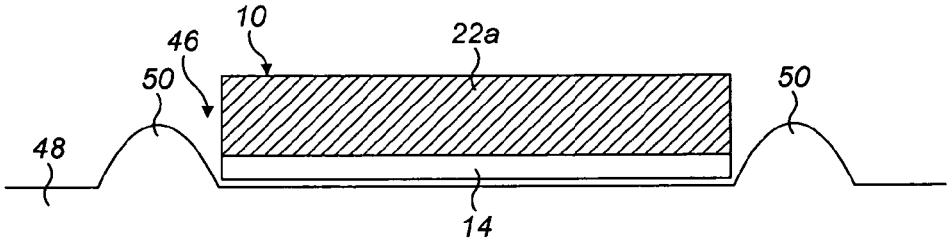
FIG. 7 shows a schematic sectional view of a layer of sediment as one embodiment of suction mouth passes through it.

Due to the finite width of the suction mouth 10 sediment recovery in an area is normally done by making a series of parallel traverses with the subsea vehicle 32, creating a series of lanes 46 cut through the sediment layer 48. For best suction effectiveness it is important that the suction: mouth 10 sucks up the sediment layer 48 at a nominal thickness over the full width of the suction mouth 10. This can be inhibited if the side of the suction mouth 10 adjacent a lane 46 which has already been traversed is not fully covered in sediment and therefore a large amount of water is taken in that part of the suction mouth 10. Therefore, it is preferable if ridges 50 of sediment are left between the lanes 46 as indicated in FIG. 7.

Figure 8A:
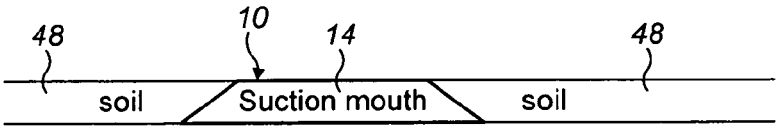
FIGS. 8*a*-8*d* show schematic sectional views of a layer of sediment as another embodiment of suction mouth passes through it.
Figure 8B:
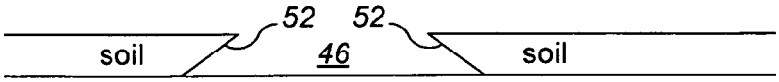
Figure 8C:
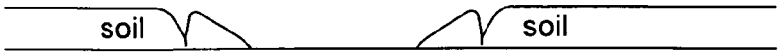
Figure 8D:
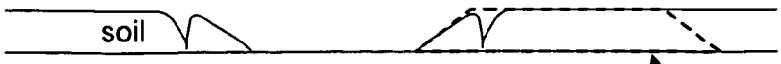

However, the recovery efficiency of the sediment quickly falls with increasing width of the ridges 50. Therefore, to improve efficiency, the entrance opening 14 of the suction mouth 10 is preferably the wide, shallow trapezium shape mentioned above. As shown in FIGS. 8*a*-8*d*, as the suction mouth 10 passes through the sediment layer 48 it leaves a cleared lane 46 with overhangs 52 on each side as best seen in FIG. 8*b*. These overhangs 52 will tend to collapse into the cleared lane 46 as in FIG. 8*c*. The resultant shape approximately matches the shape at the edge of the entrance opening 14 so that in the next pass, as shown in FIG. 8*d*, the collapsed portion of material can be taken into the entrance opening 14 to avoid leaving a ridge of material 50 between adjacent lanes 46. Thus, recovery of sediment is maximised.

The invention claimed is:

1. A subsea mining tool comprising:

a subsea vehicle including a suction mouth mounted on the front of the vehicle, wherein the suction mouth is operable to be pushed into sediment, and wherein the suction mouth comprises a hollow body having an entrance opening and an exit opening, wherein the body converges from the entrance opening towards the exit opening, the entrance opening has a lower lip and an upper lip, and wherein the upper lip comprises an extension projecting forwardly and upwardly relative to the lower lip to form a canopy over the entrance opening, wherein the suction mouth further comprises:

a valve on the body downstream of the entrance opening which is operable to selectively provide a further entrance opening into the body; and wherein the subsea mining tool further comprises a detection system for detection of different layers of sediment to be mined, detection of obstacles and monitoring the path of the tool.

2. The subsea mining tool of claim 1, further comprising a plurality of guide plates spaced across and the width of the entrance opening and projecting downwardly from the upper lip extension to the lower lip.

3. The subsea mining tool of claim 1, further comprising a glide shoe formed on the underside of the lower lip.

4. The subsea mining tool of claim 1, wherein the entrance opening is rectangular.

5. The subsea mining tool of claim 1, wherein the entrance opening is trapezoidal, narrowing from the lower lip towards the upper lip.

6. The subsea mining tool of claim 1, further comprising one or more nozzles for providing jets of fluid.

7. The subsea mining tool of claim 6, wherein one or more nozzles are located on the upper lip extension.

8. The subsea mining tool of claim 6, wherein one or more nozzles are located on the lower lip.

9. The subsea mining tool of claim 6, wherein the entrance opening has a maximum width of 10 m and a maximum height of 0.35 m.

10. The subsea mining tool of claim 1, wherein the suction mouth is pivotably connected to the subsea vehicle.

11. The subsea mining tool of claim 1, further comprising means to adjust the position of the suction mouth relative to the subsea vehicle.

12. The subsea mining tool of claim 11, wherein the means to adjust the position of the suction mouth relative to the subsea vehicle comprises one or more hydraulic cylinders.

13. The subsea mining tool of claim 1, wherein the exit opening of the suction mouth is connected to a suction system on the vehicle by a flexible pipe.

14. The subsea mining tool of claim 1, wherein the detection system comprises at least one sensor mounted on a frame extending above and in front of the suction mouth, the or each sensor arranged to face downwardly towards the sediment.

15. The subsea mining tool of claim 1, further comprising at least one sensor arranged to face forwardly in the direction of travel of the tool for path and obstacle detection.

* * * * *